US005833089A

United States Patent [19]

Manni et al.

[11] Patent Number: 5,833,089

[45] **Date of Patent: *Nov. 10, 1998**

[54] PACKAGING FOR THE EXTEMPORANEOUS PREPARATION OF DRUG PRODUCTS

[76] Inventors: Charles Manni, 63, Bld du Jardin Exotique, MC98000 Monaco (pte); Jean Pierre Augier, 54, Bld General Delfino, 06000 Nice, both of France

[ * ] Notice: The terminal 13 months of this patent has been disclaimed.

[21] Appl. No.: 956,668

[22] Filed: Oct. 2, 1992

[30] Foreign Application Priority Data

Oct. 4, 1991 [FR] France ..... 91 12494

[51] Int. Cl.[6] ..... B65D 41/62

[52] U.S. Cl. ..... 215/249; 215/251; 215/DIG. 3; 215/DIG. 8; 141/319; 141/329; 141/25; 141/363; 141/366; 141/386; 206/219

[58] Field of Search ..... 215/249, 250, 215/251, 100 R, DIG. 3, DIG. 8, 32, 33; 220/265, 270, 276, 257; 141/319, 320, 329, 330, 25, 26, 27, 363, 364, 365, 366, 383, 384, 385, 386; 206/219

[56] References Cited

U.S. PATENT DOCUMENTS

| | | | |
|---|---|---|---|
| 3,416,712 | 12/1968 | Shastal | 215/33 |
| 4,284,199 | 8/1981 | Bigarella | 215/32 |
| 4,394,919 | 7/1983 | von Alven et al. | 215/253 |
| 4,430,077 | 2/1984 | Mittlemon et al. | 215/249 X |
| 4,746,017 | 5/1988 | Howard et al. | 215/249 X |
| 4,757,911 | 7/1988 | Larkin et al. | 220/249 X |
| 4,863,049 | 9/1989 | Suzuki et al. | 215/249 |
| 4,926,915 | 5/1990 | Deussen et al. | 141/290 |
| 4,986,322 | 1/1991 | Chilbret et al. | 141/319 |

FOREIGN PATENT DOCUMENTS

| | | | |
|---|---|---|---|
| 0350715 | 1/1990 | European Pat. Off. . | |
| 2315173 | 10/1974 | Germany | 215/249 |
| 2509504 | 9/1976 | Germany | 215/249 |
| 2716447 | 10/1978 | Germany | 215/249 |

*Primary Examiner*—Stephen Cronin
*Attorney, Agent, or Firm*—Morgan & Finnegan, LLP

[57] ABSTRACT

A connector for connecting two containers includes a first portion releasably secured to the neck of the first container and a second portion having an access opening. A closure member for sealing the access opening of the connector includes a cover for sealably closing the access opening, the cover being fixed to the connector so as to include a breakable point of attachment and a zone of weakness disposed on the periphery of the cover. The cover includes a tab disposed generally perpendicular to the cover and a strut angularly disposed between the tab and the cover such that the exertion of pressure substantially normal to the tab causes the cover to release from the connector at the zone of weakness and the rotation of the cover causes release of the cover from the connector at the breakable point of attachment.

7 Claims, 5 Drawing Sheets

PACKAGING FOR THE EXTEMPORANEOUS PREPARATION OF DRUG PRODUCTS

BACKGROUND OF THE INVENTION

This invention concerns an improvement in packaging items intended for the extemporaneous preparation of suspensions or solutions of an active product, generally solid, in a liquid product. The container includes separate hermetically closed flasks, with means of connection serving to establish communication between these two flasks. Thus, in a first step, the liquid is permitted to pass from the first flask in which it is contained to a second flask which contains the solid. In a second step, the solution or suspension thus formed is reaspirated into the first flask.

The means of connection may comprise a single plastic molded part having an upper portion threaded internally so that it can be screwed onto the neck of the second flask containing the solid product. The second flask is closed by an elastomer stopper having an axial perforation and closed by a valve which can be perforated and having on the inside a shoulder intended to snap onto one or more circular collars of the neck of the second flask.

Such a device is described in U.S. Pat. No. 4,986,322 (European Patent No. 0238629) in the name of the Applicant, said patent being incorporated herein by reference. It presents the feature of having, simply fitting of the upper orifice of this molded part, a protective plastic cap which covers this part after crimping or snapping on the second flask containing the solid.

However such a cap represented a substantial cost because it was necessary not only to produce it separately from the threaded part, but also to sterilize it and finally to fit it on the upper orifice of this part.

Moreover, this part was simply fitted on; it was not inviolable and nothing in fact guaranteed the user that this protection had not been removed and then replaced, thus making the sterilization of no value.

Thus, one of the aims of the invention is to furnish such a device which can be produced almost automatically, and more economically, and operated easily.

The goals, as well as others which will appear in the following description, are attained by a packaging device such as described above which is characterized, according to this invention, by the fact that the upper portion is closed hermetically by a cover molded of a single piece with the connecting part and comprises means of manual rupture to release the upper orifice of this upper portion at the moment of utilization.

Preferably, the means of manual rupture of the cover comprises a vertical tab intended to undergo the horizontal pressure of the user, and a strut intended to convert this pressure to a vertical tension which, by lever effect on the disk, causes a tearing of the weak zone connecting the disk and the portion of the part and the breaking of a point of connection of this disk on this upper portion.

SUMMARY OF THE INVENTION

In one embodiment of the invention, the zone of weakness is located at the foot of the tab and the breaking point of connection is at the base of the strut.

In another embodiment, the zone of weakness is located at the base of the strut and the breaking point is at the foot of the tab.

BRIEF DESCRIPTION OF THE DRAWINGS

The foregoing and other objects and advantages of the invention will be appreciated more fully from the following description, which is intended to be illustrative and not limiting, with reference to the attached figures among which.

DETAILED DESCRIPTION OF THE DRAWINGS

Figure 1:
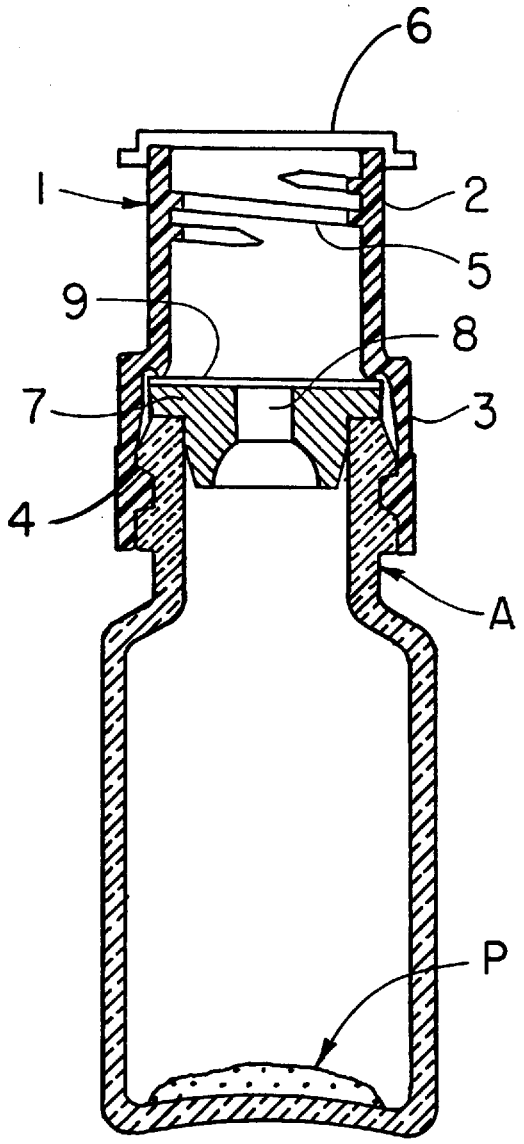
FIG. 1 PRIOR ART
FIG. 1 is a vertical section of the flask containing the solid, on which snaps the connecting part according to the prior art.

Referring first to FIG. 1, one sees a flask A, similar to flask A of the aforementioned European patent, and intended to contain a freeze-dried solid P which is to be set in solution in a liquid contained in a second flexible flask (not represented) when this second flask is made to communicate with the previous one thanks to a connecting part designated by the general reference 1.

As in the prior European patent, this connecting part comprises an upper portion 2 and a lower portion 3, made in a single piece by molding a plastic material, for example, polyethylene.

The upper portion 2 is threaded at 5 so that it can be screwed on the second flask containing the liquid and the lower part 3 snaps at 4 on the shoulder of the neck of the flask A.

All these features are known from the aforementioned European patent and it is therefore not necessary to describe them in further detail.

In the prior execution, a separate cap 6 is snapped onto the upper orifice of portion 2.

The flask A containing the freeze-dried product P is closed by an elastomer stopper 7 which is perforated at 8 and surmounted by a valve 9 made of an aluminum/polyethylene composition suitable for perforation was thus supplied to the user equipped with the part 1 covered by the cap 6.

As a result, even if the product P was well preserved in sterile conditions, the interior space of part 1 remained sterile only as long as the cap 6 was kept in place and snapped in a sealed manner. If, for any reason, the cap 6 was removed and then replaced, it was possible for any polluting impurity to penetrate the interior space, then to be introduced in the flask A with the liquid at the moment the valve 9 was perforated.

Figure 2:
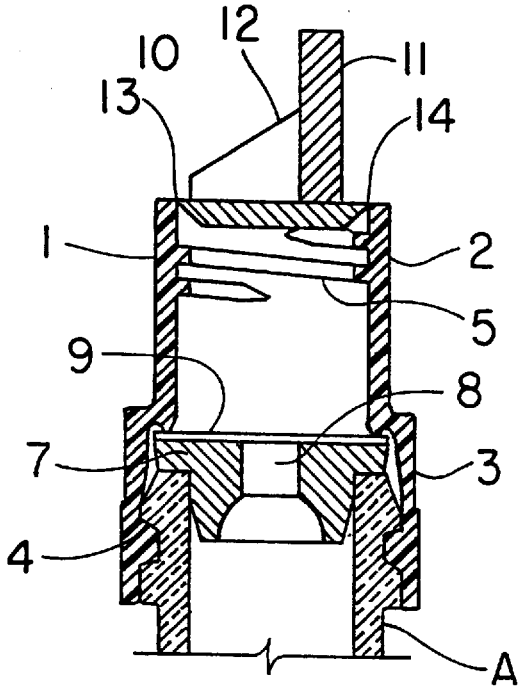
FIG. 2 illustrates a similar connecting part according to the present invention.
Figure 3:
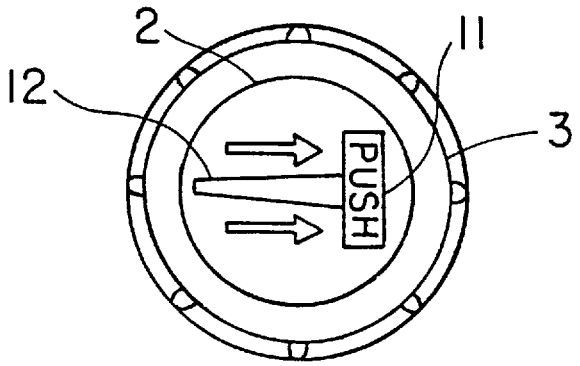
FIG. 3 is a top view of FIG. 2.

Referring to FIG. 2, in order to avoid this danger, according to the invention, the top of the portion 2 is closed by a cover or disk 10, which may be molded in a single part with the connecting part 1 and which, also according to the invention, can easily be broken by a push of the thumb against an off-centered vertical tab 11 connected to the cover 10 by a strut 12.

A breakable point of attachment 14 or 114 (see FIGS. 5*a* and 5*b*) situated between the disk 10 and the part 1 serves as a pivot to avoid the penetration of the disk inside the upper portion 2 of the part 1.

This point of attachment is easily broken by a rotary movement of the cover 10.

Figure 4B:
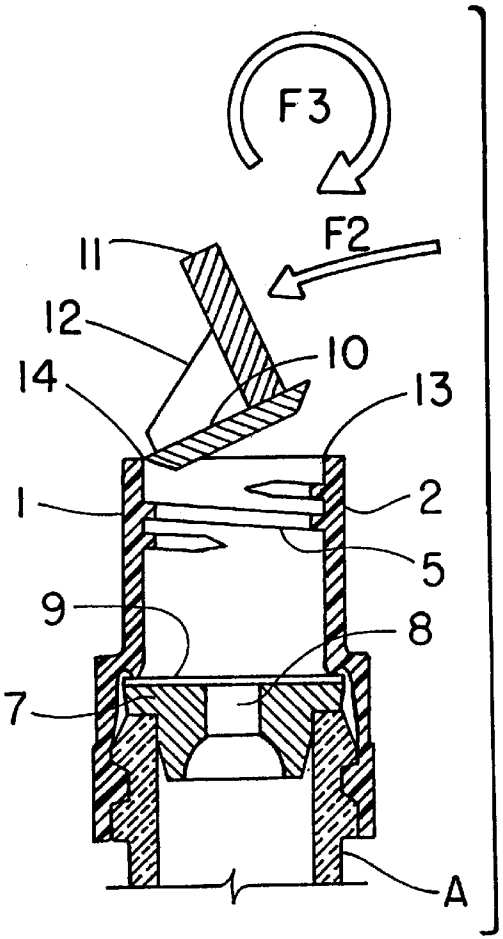
FIGS. 4A, 4B and 4C illustrate a first embodiment of the connecting part according to the invention.
Figure 4A:
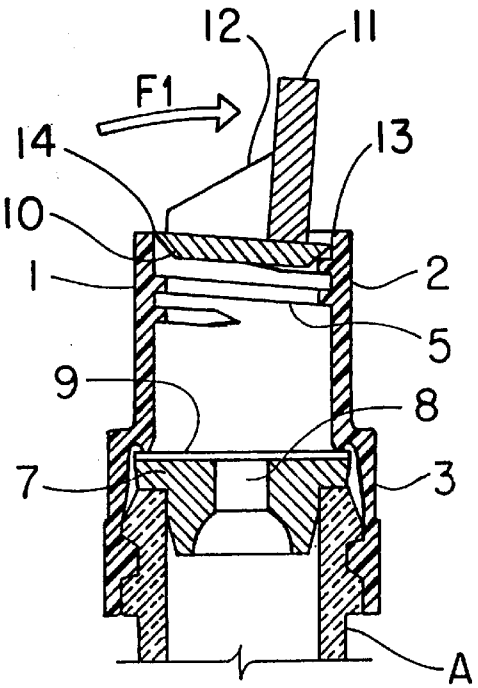
Figure 4C:
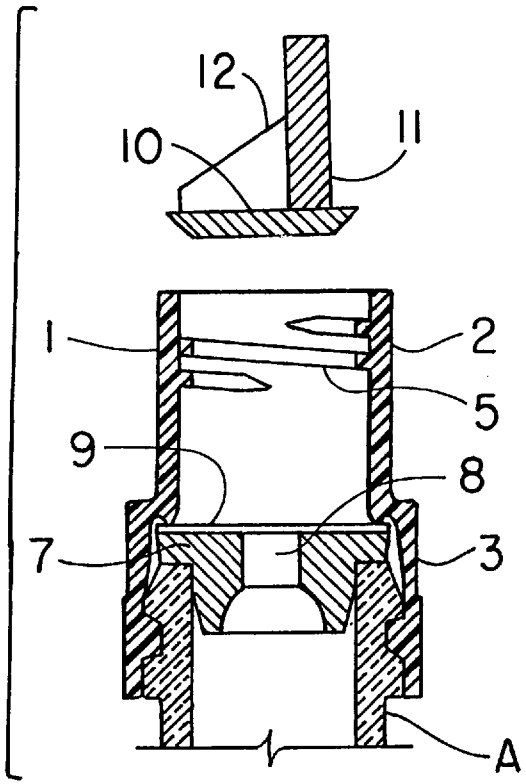

According to one embodiment of this device such as represented in FIGS. 4A, 4B and 4C, by exerting a horizontal pressure against the tab 11 in the direction indicated by the arrow F 1, the zone of weakness 13, situated at the base of this tab 11, in the connection of the cover 10 with the upper portion 2 undergoes an onset of breakage and the disk 10 descends slightly in the direction of this thrust (FIG. 4A).

By a slight pressure in the opposite direction in the direction of the arrow F 2 (FIG. 4B), the zone of weakness 13 tears completely about the disk 10 while remaining ultimately attached to the edge by a breakable point of attachment 14.

The user now only has to detach this cover 10 by a simple movement of rotation F 3 which causes this point of attachment 14 to break.

By the fact of the breakage of the zone of weakness 13 and of the point of attachment 14, the disk 10 (FIG. 4C) is totally released and the orifice of the upper portion 2 of the part 1 is free, thus making it possible to screw a second flask in the threading 5, as is known.

The strut 12, which is fixed and preferably unitary with the disk 10 and the tab 11, serves to convert the horizontal pressure exerted on the tab 11 to a vertical traction on this disk; this causes tearing of the zone of weakness 13 connecting the disk 10 to the connecting part 1.

Figure 5A:
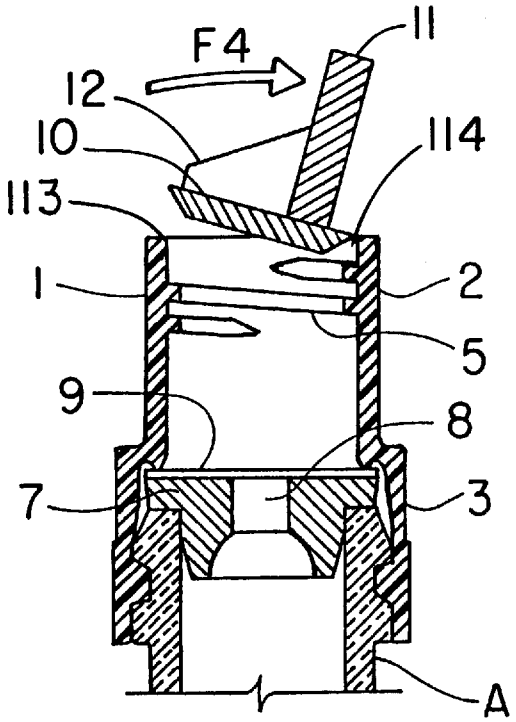
FIGS. 5A, 5B and 5C illustrate a second embodiment of the connecting part according to the invention.
Figure 5C:
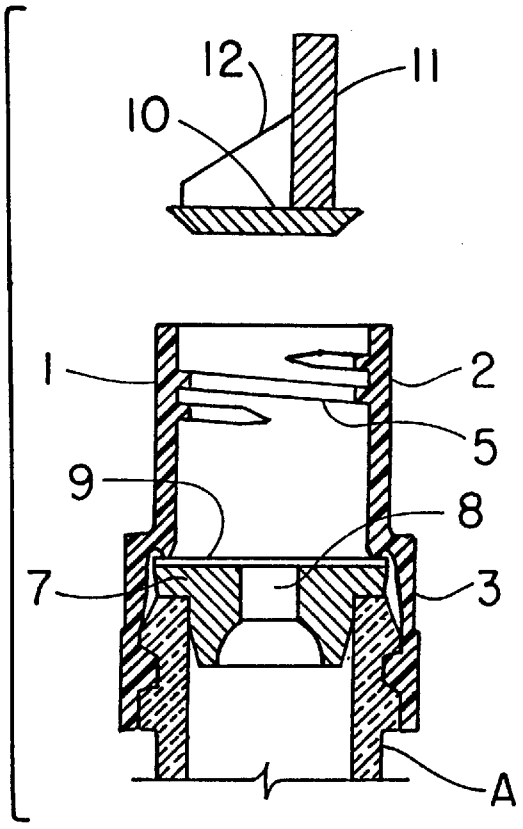
Figure 5B:
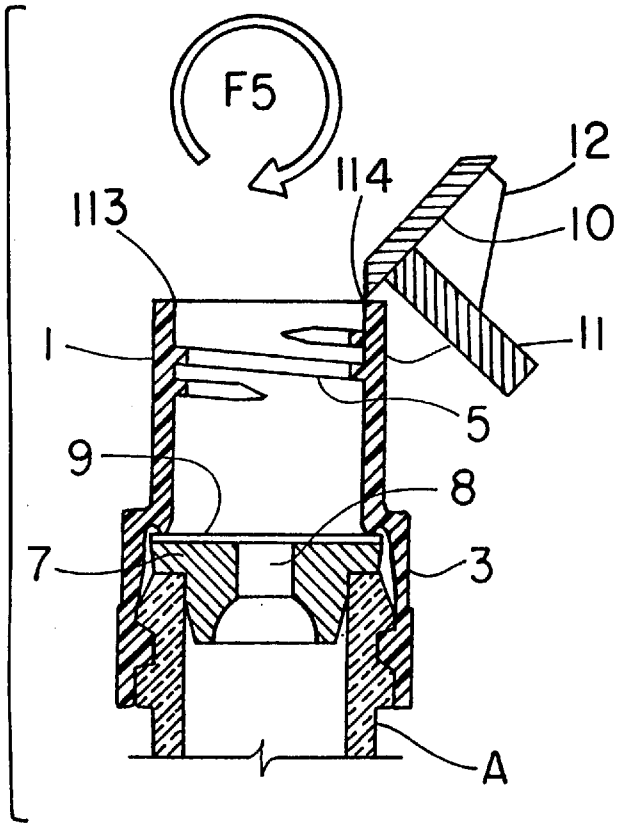

According to a second embodiment of the invention represented in FIGS. 5A, 5B and 5C, in which the elements identical to those of FIGS. 4A, 4B and 4C bear the same reference numbers, a horizontal pressure is exerted against the top of the tab 11, in the direction of the arrow $F_4$ so as to create an onset of breakage in the zone of weakness 113 which is situated at the base of the strut 12.

Continuing the thrust in the direction of the arrow $F_4$, the zone of weakness 113 breaks, thus allowing the disk 10 (FIG. 5B) to pivot about the point of attachment 114 located at the base of the tab 11. The disk 10 remains attached to the edge of the part 1 by the point of connection 114. The user now has only to detach this cover 10 by a simple movement of rotation, in the direction of the arrow $F_5$, which causes the rupture of this breakable point of attachment 114.

As represented in FIG. 5C, the disk 10 is totally detached. The orifice of the upper portion 2 of the connecting part 1 is therefore free, thus making it possible to screw a second flask in the threading 5, as is known.

In this embodiment, the strut 12, which is fixed to and preferably unitary with the disk 10 and the tab 11, makes it possible to retain this tab 11 in a position substantially perpendicular to the disk 10 throughout the opening phase: it thus converts the horizontal pressure exerted against the tab 11 in a vertical traction on the disk 10, as in the first mode of execution.

As has been mentioned before, such a device affords the following advantages, namely:

the molding in a single piece represents a saving;

the interior sterility of the part is maintained until and during the utilization of the device;

the installation of the part can be made completely inviolable; and the closing element of the part is both inviolable, since it must be broken before the device can be utilized, and easy.

What is claimed is:

1. A connector for connecting two containers, at least one of said containers having a neck portion and an access opening, comprising:

(a) an attachment portion fixedly connected to the neck of said one container;

(b) a connection portion connected to said attachment portion at one end and having an access opening at its other end;

(c) a, cover fixedly attached to said connection portion for sealably closing the access opening of said connection portion, said cover including a breakable point of attachment to said connection portion and a frangible zone of weakness disposed about the periphery of the cover;

(d) a tab member fixedly attached to and disposed generally perpendicular to said cover member; and (e) a strut member fixedly connected to and disposed between said tab member and said cover member, said strut member including means for converting a force normal to said tab member to a force normal to said cover member such that the exertion of pressure substantially normal to the tab causes the cover to release from the connector at said frangible zone of weakness and the rotation of the cover causes release of the cover from the connector at the breakable point of attachment.

2. A connector as recited in claim 1 wherein said cover is unitary with said connector and said tab member and strut member are unitary with said cover member.

3. A connector as recited in claim 1 wherein the tab member is disposed off-center of the cover member.

4. A closure member for sealing a connector for a pair of containers, the connector being fixedly attached to one of said containers, said connector having an access opening comprising:

(a) a cover fixedly attached to said connector for sealably closing the access opening of said connector, said cover including a breakable point of attachment to said connector and a frangible zone of weakness disposed about the periphery of the cover;

(b) a tab member fixedly attached to and disposed generally perpendicular to said cover member; and (c) a strut member fixedly connected to and disposed between said tab member and said cover member, said strut member including means for converting a force normal to said tab member to a force normal to said cover member such that the exertion of pressure substantially normal to, the tab causes the cover to release from the connector at said frangible zone of weakness and the rotation of the cover causes release of the cover from the connector at the breakable point of attachment.

5. Packaging for the extemporaneous preparation of suspensions and solutions of an active solid product in a liquid, comprising:

a first hermetically-sealed flask containing the liquid, said first flask having a threaded neck;

a second hermetically-sealed flask containing the solid, said second flask having at least one collar;

connection means for establishing communication between the two flasks to allow the liquid to pass from the first flask to the second flask, said connection means having a single part molded of plastic, the single part having:

an internally threaded part adapted to be screwed on to the threaded neck of the first flask; and a cap portion adapted to cap the second flask, said cap portion including an elastomeric stopper in said cap having an axial perforation therethrough to enable the liquid to flow from said first flask to said second flask, a valve for the perforation for closing said perforation, and a shoulder for snapping on the collar of said second flask;

a cover molded in a single piece with the connecting part, said cover hermetically closing said internally threaded part, and said cover having a surface external to said internally threaded part;

means for manually rupturing the cover application of a force parallel to the external surface of the cover, whereby to open the connecting means.

6. The packaging of claim 5, wherein said cover further comprises a bar having an end and a zone of weakness at said bar end and a strut, said strut having a breakable point of attachment for coupling said cover to said connecting means.

7. The packaging of claim 5, wherein the cover further comprises a strut, said strut having a zone of weakness, and a bar, said bar having breakable point of attachment for coupling said cover to said connecting means.

* * * * *